US006397944B1

(12) United States Patent
Caldwell

(10) Patent No.: US 6,397,944 B1
(45) Date of Patent: Jun. 4, 2002

(54) HEAT DISSIPATING APPARATUS AND METHOD FOR ELECTRONIC COMPONENTS

(75) Inventor: Barry E. Caldwell, Hesston, KS (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/494,070

(22) Filed: Jan. 28, 2000

(51) Int. Cl.[7] ..... G05D 23/00; F28F 27/02
(52) U.S. Cl. ..... 165/296; 165/80.2; 165/100
(58) Field of Search ..... 165/80.1, 80.2, 165/80.3, 80.4, 80.5, 96, 97, 100, 101, 102, 103, 296, 297, 298, 146

(56) References Cited

U.S. PATENT DOCUMENTS 3,669,812 A * 6/1972 Ensslin ..... 165/80.4 X
3,776,305 A * 12/1973 Simmons ..... 164/80.4 X
4,051,509 A * 9/1977 Beriger et al. ..... 165/80.4 X
4,464,932 A * 8/1984 Ewing et al.
5,941,083 A * 8/1999 Sada et al. ..... 165/80.5 X
6,167,621 B1 * 1/2001 Goth et al. ..... 165/80.4 X

* cited by examiner

*Primary Examiner*—Ljiljana Ciric
(74) *Attorney, Agent, or Firm*—Maginot, Moore & Bowman LLP

(57) ABSTRACT

A method and apparatus dissipates heat generated by an electronic device. The apparatus includes a channel structure that is in thermal communication with heat generated by the electronic device. The apparatus further includes a pump array operative to advance fluid within the channel structure. In addition, the apparatus includes a baffle array positionable in relation to the channel structure in a first group position and a second group position, wherein fluid advancing within the channel structure is diverted to flow (i) in a first flow path defined in the channel structure when the baffle array is positioned in the first group position, and (ii) in a second flow path defined in the channel structure when the baffle array is positioned in the second group position.

4 Claims, 8 Drawing Sheets

KEY:

▷ = PUMP 20(N)

/ = BAFFLE 22

⊘ = SENSOR 24

HEAT DISSIPATING APPARATUS AND METHOD FOR ELECTRONIC COMPONENTS

TECHNICAL FIELD OF THE INVENTION

The present invention relates generally to dissipating heat which is generated by electronic components, and more particularly to an apparatus and method for cooling electronic components with the use of a fluid.

BACKGROUND OF THE INVENTION

Electronic components such as integrated circuit devices ("IC devices") produce heat as a byproduct of their operation. In order to counteract such heat, various mechanisms have been designed to cool electronic components. Cooling such electronic components facilitates their proper operation.

One known mechanism which cools an IC device utilizes a fan which generates a flow of air. The flow of air is directed into contact with the IC device thereby cooling such IC device. Another known mechanism for cooling an IC device utilizes a heat sink positioned in thermal communication therewith. The heat sink possesses a plurality of fins or other extensions which function to increase the heat dissipating surface area of the heat sink thereby facilitating heat dissipation of the IC device.

There have also been cooling mechanisms designed which include a heat sink having a plurality of channels defined therein, and such heat sink is positioned in thermal communication with an IC device. A cooling fluid is advanced through the plurality of channels of the heat sink. During such advancement, heat transfer occurs between the heat sink and the cooling fluid. This arrangement results in heat being dissipated from the IC device to the cooling fluid. The cooling fluid is then advanced to a remote location where it is allowed to cool. After such cooling, the process is repeated.

The above-identified designs of cooling mechanisms for IC devices do not take into account that the particular IC device which is being cooled may generate a substantial amount of heat during a first time period, and then, during a second time period, the IC device may generate relatively less heat. The above-identified designs of cooling mechanisms for IC devices are not able to actively adjust their heat dissipating abilities to accommodate time-based fluctuations of heat generation of the IC device.

Also, the above-identified designs of cooling mechanisms for IC devices do not reduce the amount of cooling activity when the particular IC device which is being cooled has been cooled beyond that which is necessary for proper operation of the IC device. The above-identified designs of cooling mechanisms for IC devices are not able to actively adjust their heat dissipating abilities in response the current temperature of the IC device.

What is needed is an improved cooling mechanism for IC devices. What is further needed is a cooling mechanism for IC devices which actively adjusts its heat dissipating abilities to accommodate time-based fluctuations of heat generation of the IC device. What is additionally needed is a cooling mechanism for IC devices which actively adjusts its heat dissipating abilities based on the current temperature of the IC device.

SUMMARY OF THE INVENTION

In accordance with a first embodiment of the present invention, there is provided a method for dissipating heat which is generated by an electronic device. The method includes the step of advancing fluid in a first flow path defined by a channel structure which is in thermal communication with heat generated by the electronic device. The method further includes the step of sensing temperature of the channel structure. In addition, the method includes the step of generating a control signal if the temperature of the channel structure has a predetermined relationship with a temperature value. The method also includes the step of advancing fluid in a second flow path defined by the channel structure in response to generation of the control signal.

Pursuant to a second embodiment of the present invention, there is provided an apparatus for dissipating heat generated by an electronic device. The apparatus includes a channel structure which is in thermal communication with heat generated by the electronic device. The apparatus further includes a temperature sensor positioned in thermal communication with the channel structure. The apparatus also includes a circuit which generates a control signal if a temperature sensed by the temperature sensor has a predetermined relationship with a temperature value. In addition, the apparatus includes a baffle positionable, in response to the control signal, between a first position and a second position , wherein (i) the baffle is positioned to direct fluid to flow in a first flow path defined by the channel structure when the baffle is located in the first position, and (ii) the baffle is positioned to direct fluid to flow in the second flow path when the baffle is located in the second position.

In accordance to yet another embodiment of the present invention, there is provided an apparatus for dissipating heat generated by an electronic device. The apparatus includes a channel structure which is in thermal communication with heat generated by the electronic device. The apparatus further includes a pump array operable to advance fluid within the channel structure. In addition, the apparatus includes a baffle array positionable in relation to the channel structure in a first group position and a second group position, wherein fluid advancing within the channel structure is diverted to flow (i) in a first flow path defined in the channel structure when the baffle array is positioned in the first group position, and (ii) in a second flow path defined in the channel structure when the baffle array is positioned in the second group position.

It is therefore an object of the present invention to provide a new method and apparatus for dissipating heat which is generated by an electronic device such as an integrated circuit.

It is moreover an object of the present invention to provide an improved method and apparatus for dissipating heat which is generated by an electronic device such as an integrated circuit.

It is yet another object of the present invention to provide a method and apparatus for dissipating heat which is generated by an electronic device which is able to increase or decrease its cooling capabilities as needed.

It is further an object of the present invention to provide a method and apparatus for dissipating heat which is generated by an electronic device which actively adjusts its heat dissipating abilities to accommodate time-based fluctuations of heat generation of the IC device.

It is moreover an object of the present invention to provide a method and apparatus for dissipating heat which is generated by an electronic device which actively adjusts its heat dissipating abilities based on the current temperature of the IC device.

The above and other objects, features, and advantages of the present invention will become apparent from the following description and the attached drawings.

DETAILED DESCRIPTION OF THE INVENTION

Figure 1:
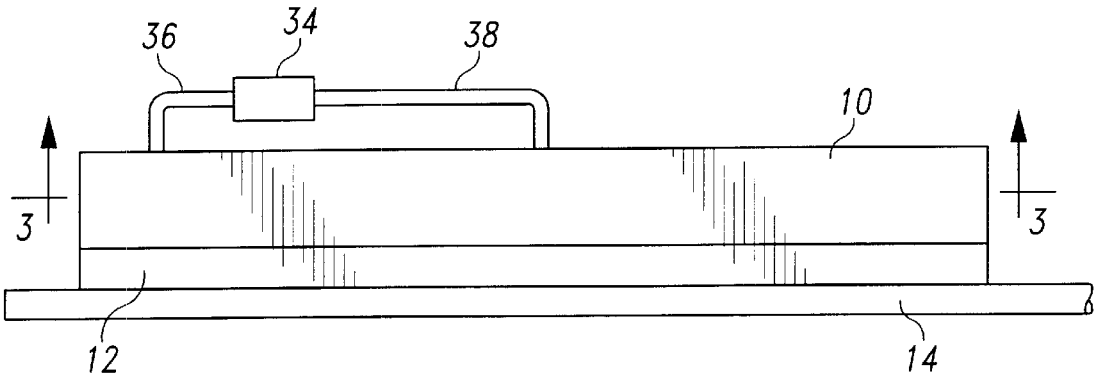
FIG. 1 is a side elevational view of a heat dissipating apparatus which incorporates the present invention therein attached to an integrated circuit device which is mounted on a printed circuit board.

While the invention is susceptible to various modifications and alternative forms, a specific embodiment thereof has been shown by way of example in the drawings and will herein be described in detail. It should be understood however, that there is no intent to limit the invention to the particular form disclosed. but on the contrary, the intention is to cover all modifications, equivalents, and alternatives falling within the spirit and scope of the invention as defined by the appended claims.

Referring now to FIG. 1, there is shown an apparatus for dissipating heat, generally indicated by reference numeral 10, which incorporates the features of the present invention therein. The heat dissipating apparatus 10 is adapted to cool an electronic device such as an integrated circuit device 12 which is mounted on a printed circuit board 14 or other suitable substrate.

Figure 2:
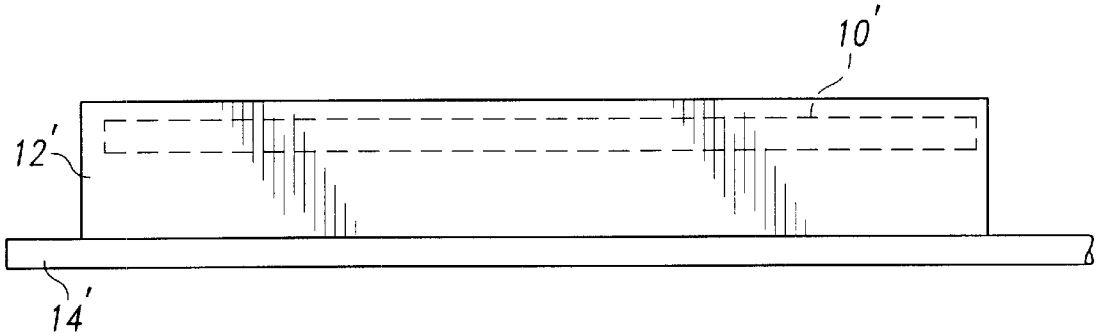
FIG. 2 is a view similar to FIG. 1, but showing a second embodiment of a heat dissipating apparatus which incorporates the present invention therein and which is integrally included in a package of an integrated circuit device which is mounted on a printed circuit board.

Alternatively, FIG. 2 shows another heat dissipating apparatus 10' which incorporates the features of the present invention therein. The heat dissipating apparatus 10' is adapted to cool an electronic device such as an integrated circuit 12' which is mounted on a printed circuit board 14' or other suitable substrate. However, in this alternative embodiment of the present invention, the heat dissipating apparatus 10' is made integral with the integrated circuit device 12'. For example, at least a portion of the heat dissipating apparatus 10' is formed in the package of the integrated circuit device 12'.

Figure 3:
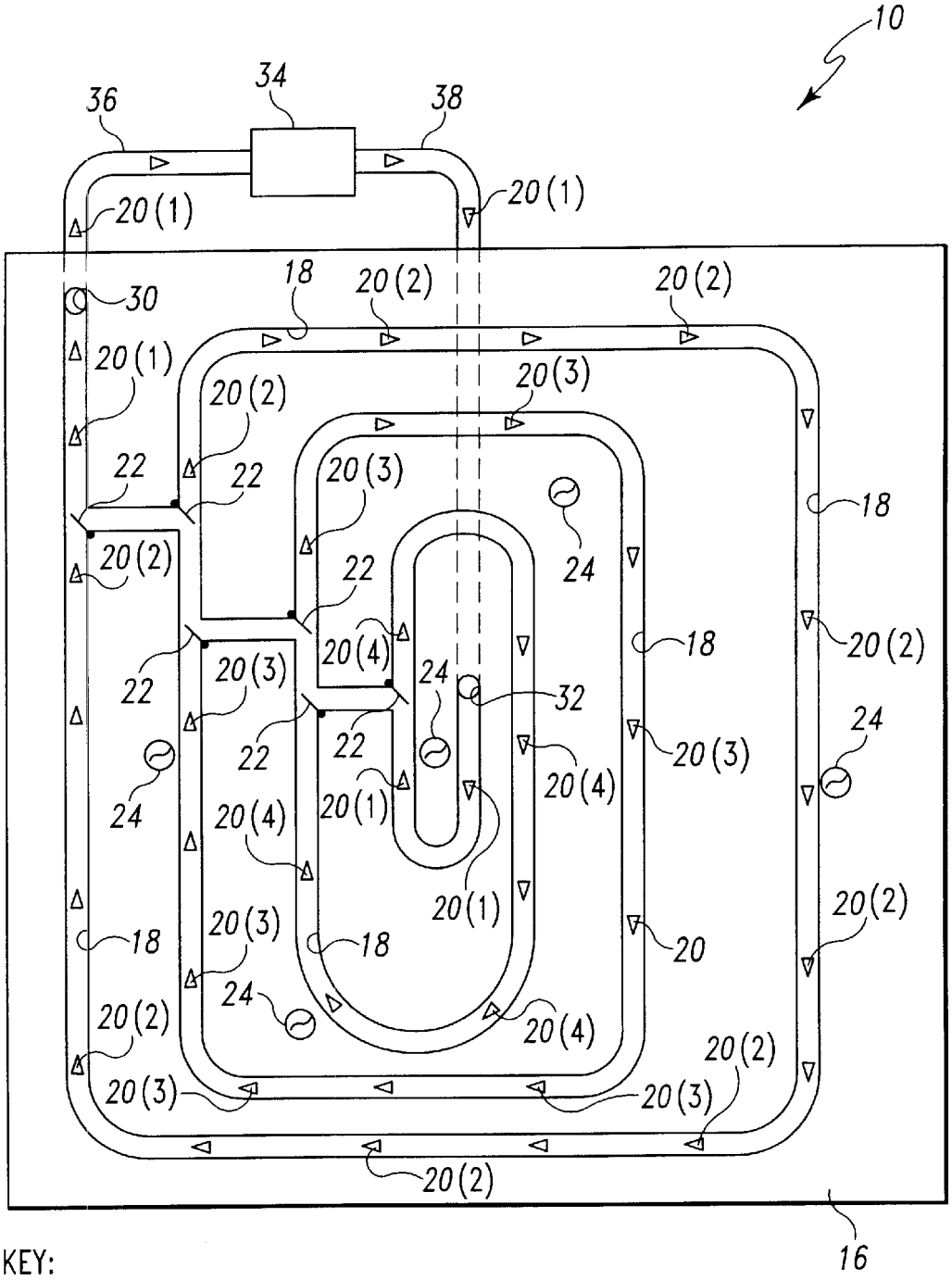
FIG. 3 is a cross-sectional view taken along the lines 3—3 of FIG. 1 as viewed in the direction of the arrows.

FIG. 3 shows a cross sectional view taken along the line 3—3 of FIG. 1. As shown in FIG. 3, the heat dissipating apparatus 10 includes a channel structure 16 having defined therein a number of channels or passages 18 through which a fluid may advance. The channel structure 16 may be made from a metallic material that dissipates heat such as aluminum. Positioned within the channels 18 are a number of pumps 20 and a number of baffles 22 as schematically shown in FIG. 3. Also positioned within the channels 18 is a fluid such as a liquid (such as FLUORINERT®, a perfluorocarbon, which is commercially available from 3M Corporation of St. Paul, Minn.).

Each of the pumps 20 is configured to cause fluid to be advanced within the channels 18. Each of the pumps 20 may be a pump possessing a size small enough to be located within the channels 20. Such a pump may include a small ceramic or metallic plate member which is reciprocated or oscillated about a post or pivot thereby causing fluid to be advanced within the channels 18. The reciprocation or the oscillation of the plate member may be caused by application of force to the plate member leverage point or attachment. Such application of force may be effected using electrostatic motivation force, faraday effect repulsion force, electromagnetic force, or fluid pneumatic or hydraulic force.

While the positioning of the pumps 20 within the channels 18 may have substantial advantages as used within the present invention, it is possible that such pumps 20 may be replace with one or more pumps which are located remote from the channels 18 and still achieve many advantages of the present invention. Such one or more pumps would be conventional in construction and operation (e.g. a common electric motor pump) and may be positioned at a location spaced apart from both the channel structure 16 and the printed circuit board 14. Such one or more conventional pumps would function to cause fluid to be advanced within the channels 18.

The heat dissipating apparatus 10 further includes a number of sensors 24, each which are positioned in thermal communication with the channel structure 16. Each of the sensors 24 may be a thermocouple sensor.

Figure 4:
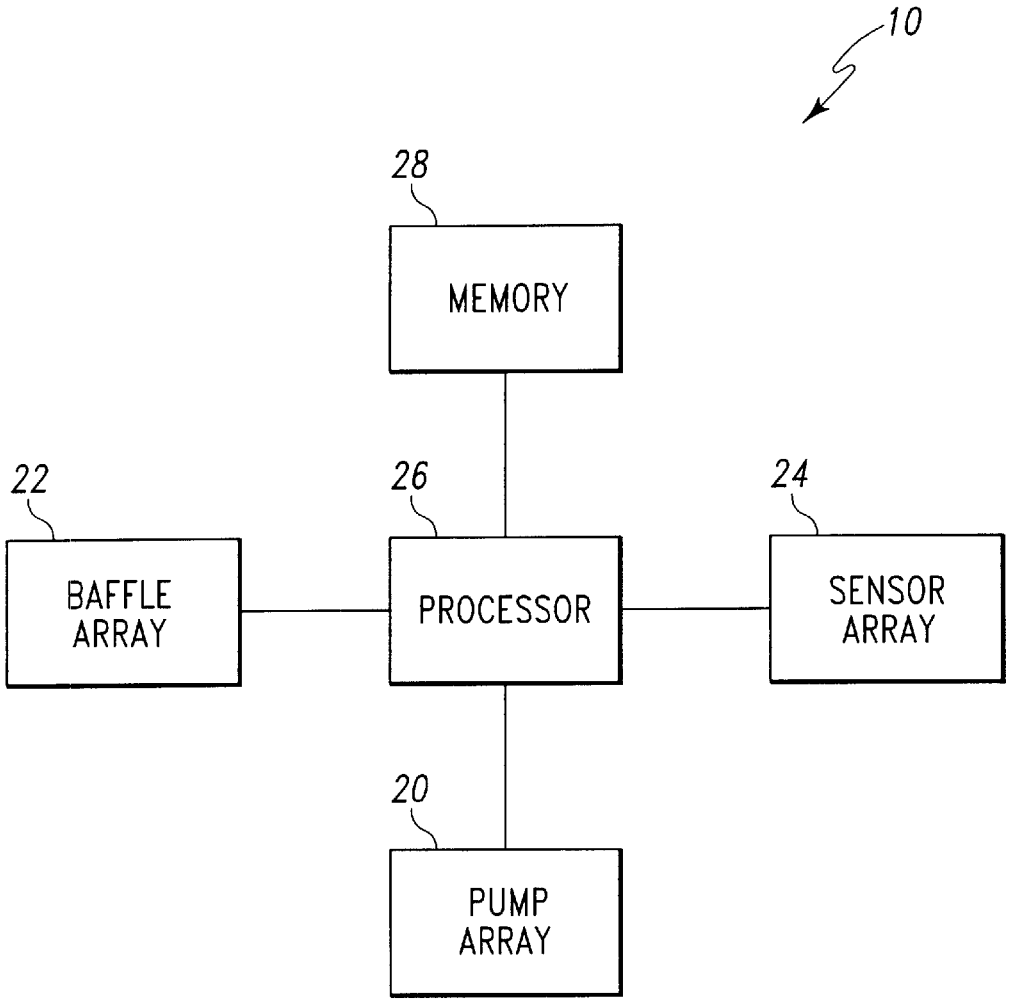
FIG. 4 is an electrical schematic diagram of the heat dissipating apparatus of FIG. 1.

FIG. 4 shows a block diagram of the electrical components of the heat dissipating apparatus 10. In particular, the apparatus 10 includes a processor 26, a memory device 28, a pump array 20, a baffle array 22, and a sensor array 24. The processor 26 executes instructions stored in the memory device 28 so as to selectively activate the pumps 20 and the baffles 22 at various times during operation of the heat dissipating apparatus 10. Selective activation of the pumps 20 and the baffles 22 are based upon temperature inputs supplied to the processor 26 by the sensors 24 as will be discussed in more detail below.

The number of pumps 20 includes four groups of pumps: level I pumps 20(1), level 2 pumps 20(2), level 3 pumps 20(3), and level 4 pumps 20 (4). Each pump group is activated independently of the other pump groups. For example, when the level 1 pumps 20(1) are operating, the level 3 pumps 20(3) may be inactive. However, all pumps of one particular group operate together or alternatively are all inactive. For example, the level 2 pumps 20(2) are shown to include eighteen pumps 20(2) in FIG. 3, and are operated as a group to all be functioning to advance fluid within the channels 18, or to all be inactive so as to not cause fluid to be advanced within the channels 18.

Figure 6:
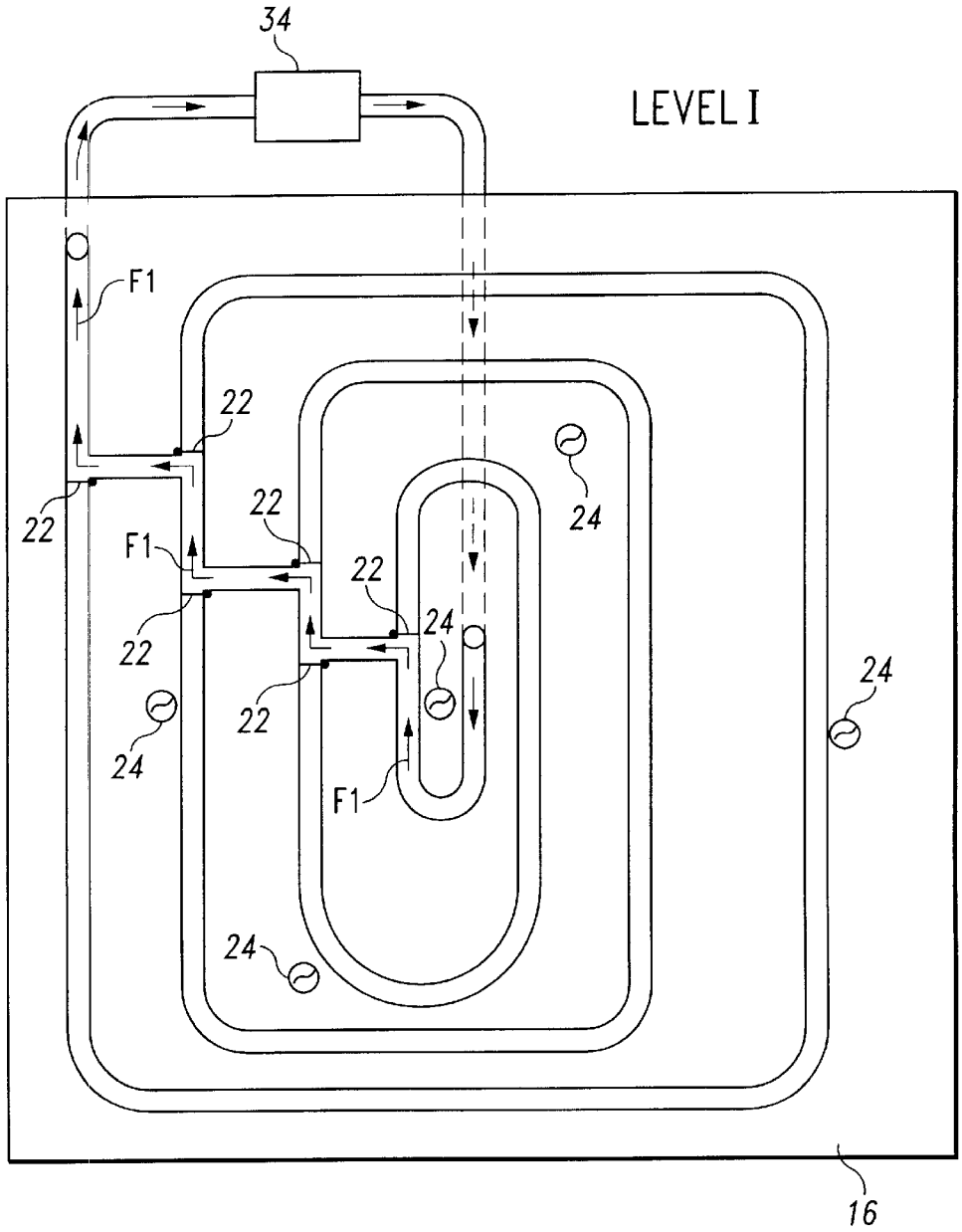
FIG. 6 is a view similar to FIG. 3, but showing the recirculating path of movement of fluid flow within the channels of the heat dissipating apparatus when (i) the baffles 22 are set to their level I group position, and (ii) the pumps (1) are operating to advance fluid within the channels 18.
Figure 7:
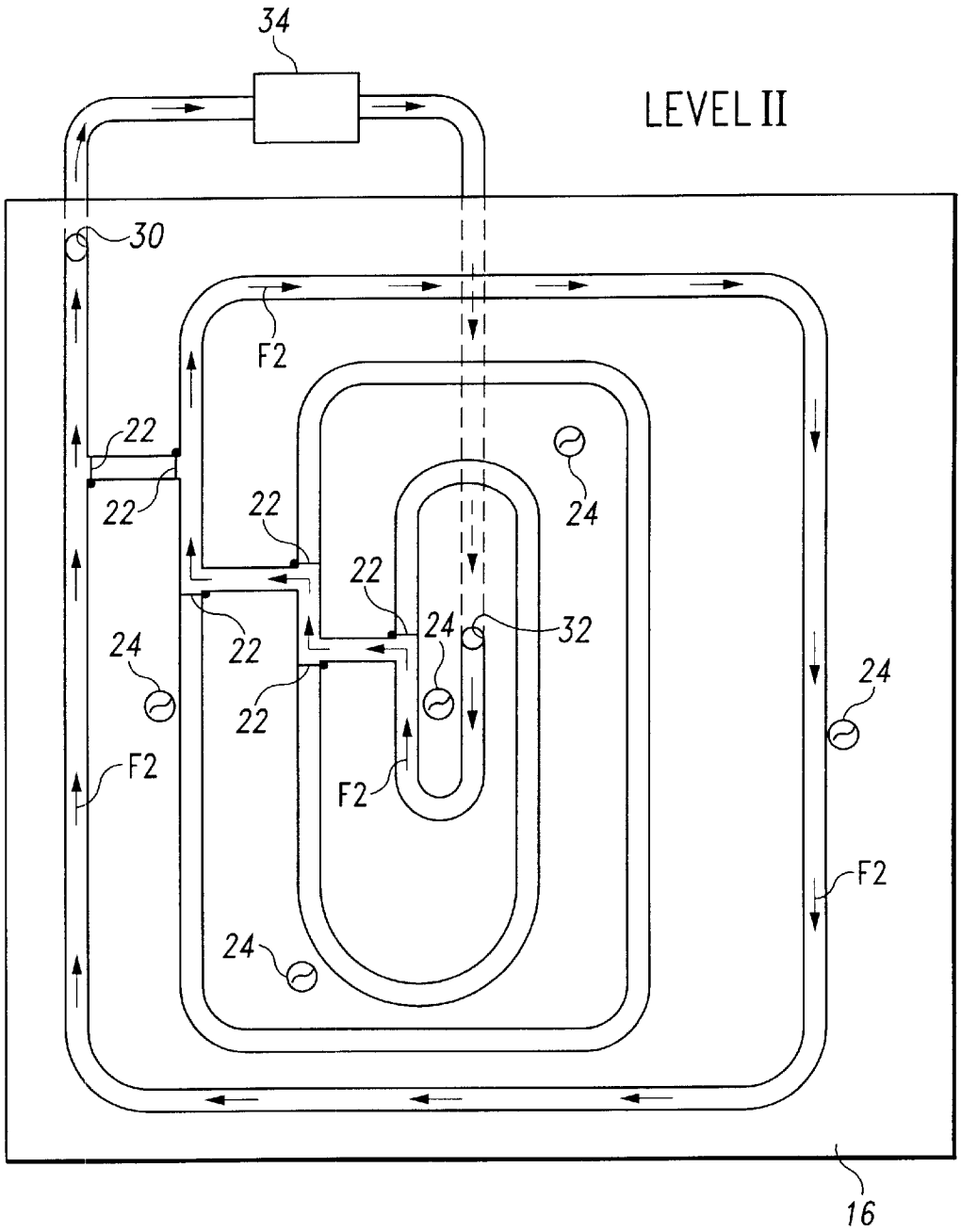
FIG. 7 is a view similar to FIG. 6, but showing the recirculating path of movement of fluid flow within the channels of the heat dissipating apparatus when (i) the baffles 22 are set to their level II group position, and (ii) the pumps 20(1) and 20(2) are operating to advance fluid within the channels 18.
Figure 8:
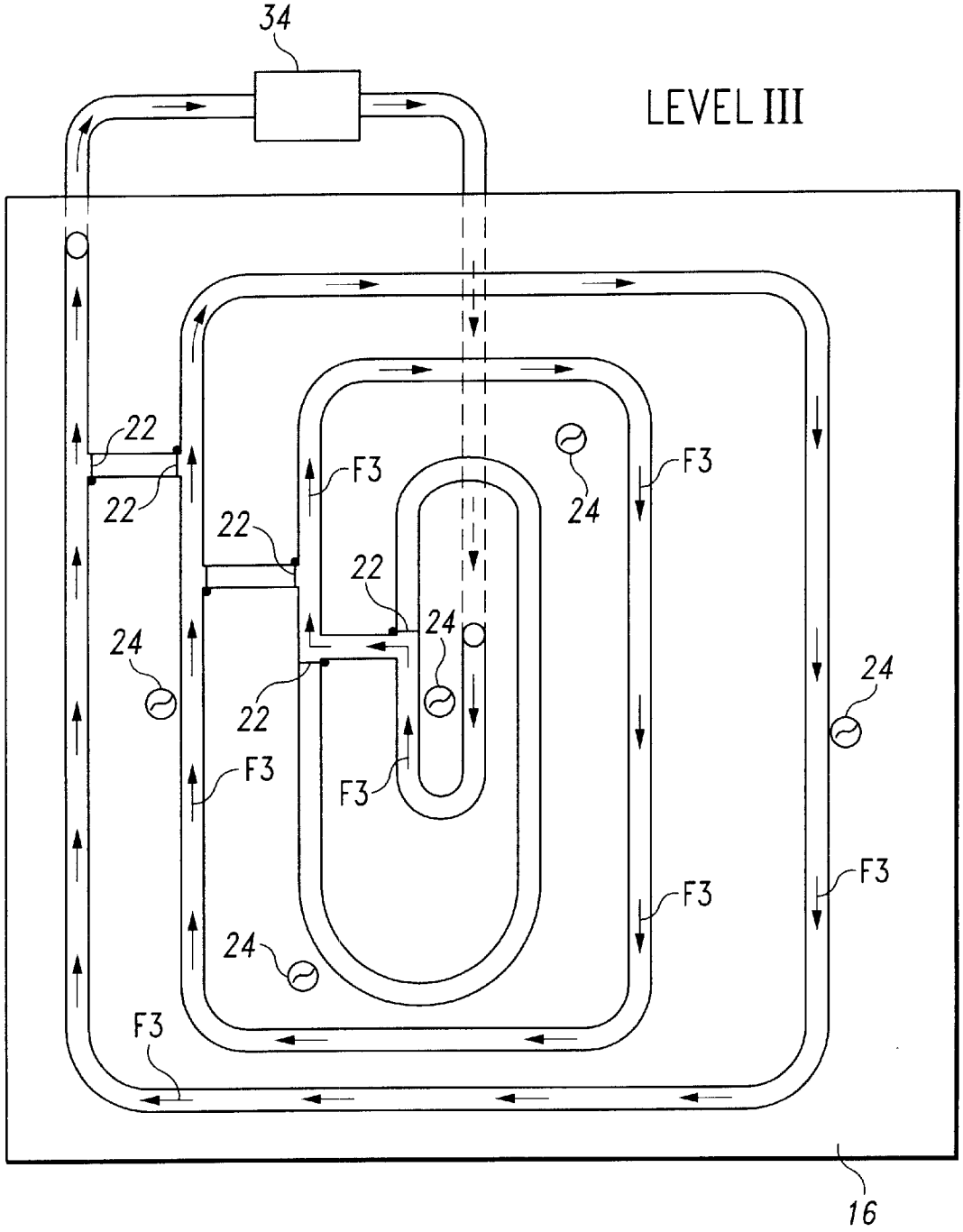
FIG. 8 is a view similar to FIG. 6, but showing the recirculating path of movement of fluid flow within the channels of the heat dissipating apparatus when (i) the baffles 22 are set to their level III group position, and (ii) the pumps 20(1), 20(2), and 20(3) are operating to advance fluid within the channels 18.
Figure 9:
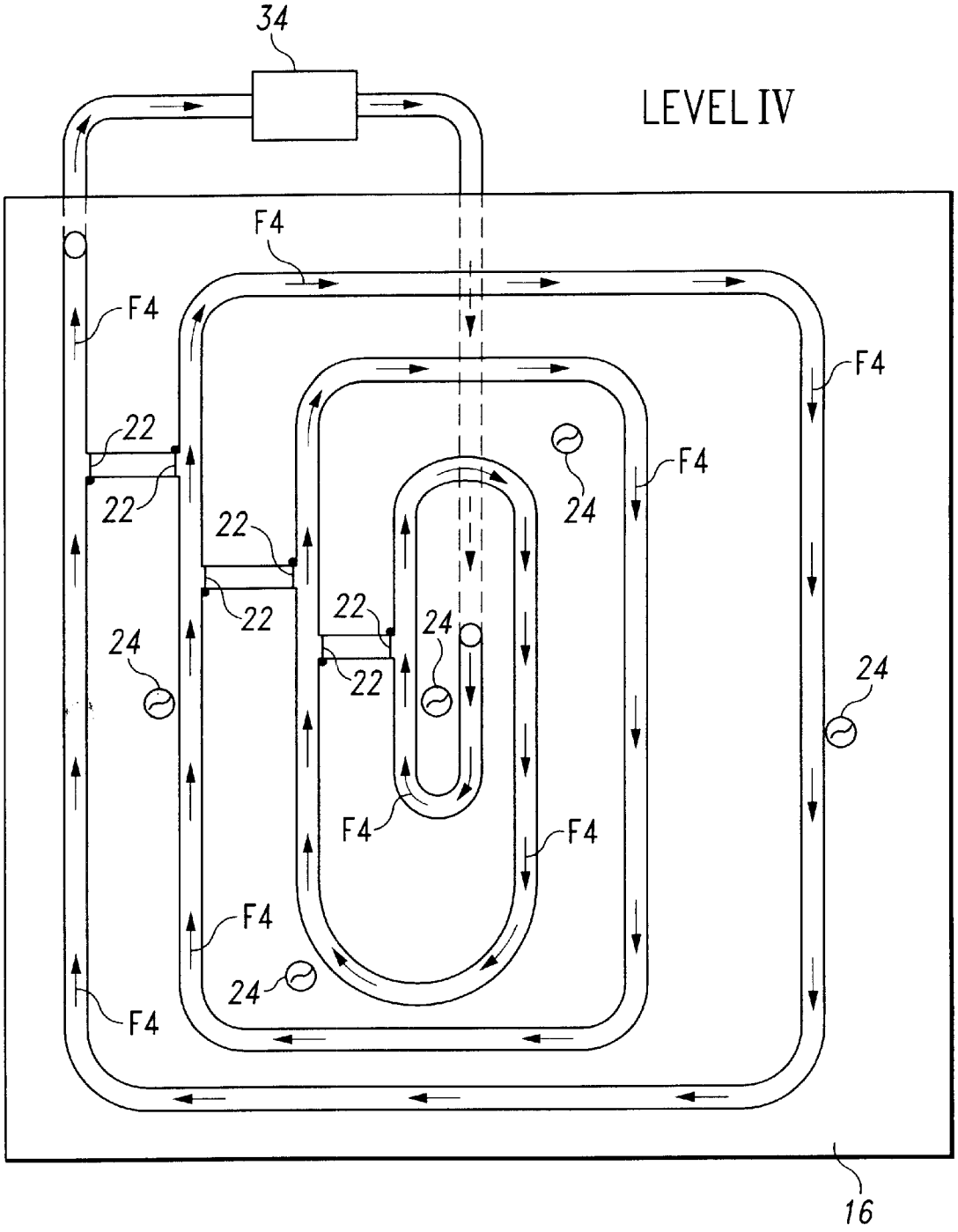
FIG. 9 is a view similar to FIG. 6, but showing the recirculating path of movement of fluid flow within the channels of the heat dissipating apparatus when (i) the baffles 22 are set to their level IV group position, and (ii) the pumps 20(1), 20(2), 20(3), and 20(4) are operating to advance fluid within the channels 18.

Each of the baffles 22 function to divert the flow of fluid within the channels 18 in a first direction or a second direction depending on the respective position of the baffle 22. The baffles 22, collectively as a group, may be positionable in any one of four group positions: level I, level II, level III, and level IV. The baffles 22 are positioned in their level I group position in FIG. 6, their level II group position in FIG. 7, their level III group position in FIG. 8, and their level IV group position in FIG. 9. Note that when the baffles 22 are positioned in their level I group position as shown in FIG. 6, fluid flow through the channels 18 is shown by the arrows F1. Similarly, when the baffles 22 are positioned in their level II group position as shown in FIG. 7, fluid flow through the channels 18 is shown by the arrows F2. The arrows F3 are used to identify the fluid flow through the channels 18 when the baffles 22 are positioned in their level III group position as shown in FIG. 8. And the arrows F4 are used to identify the fluid flow through the channels 18 when the baffles 22 are positioned in their level IV group position as shown in FIG. 9.

The channel structure 16 has defined therein an output port 30 and an input port 32 as shown in FIG. 3. The heat dissipating apparatus 10 further includes an auxiliary heat dissipating element 34. An input of the auxiliary heat dissipating element 34 is in fluid communication with the output port 30 of the channel structure 16 via a first external conduit 36, while an output of the auxiliary heat dissipating element 34 is in fluid communication with the input port 32 of the channel structure 16 via a second external conduit 38. The auxiliary heat dissipating element 34 may be any type of device which has the ability to receive fluid from the first external conduit 36, reduce the temperature of such fluid, deliver the reduced temperature fluid to the second external conduit 38. One example of a heat dissipating element which may be used as the auxiliary heat dissipating element 34 is a finned heat sink. Another example of a heat dissipating element which may be used as the auxiliary heat dissipating element 34 is a series of evaporation-condensing pipes.

Figure 5:
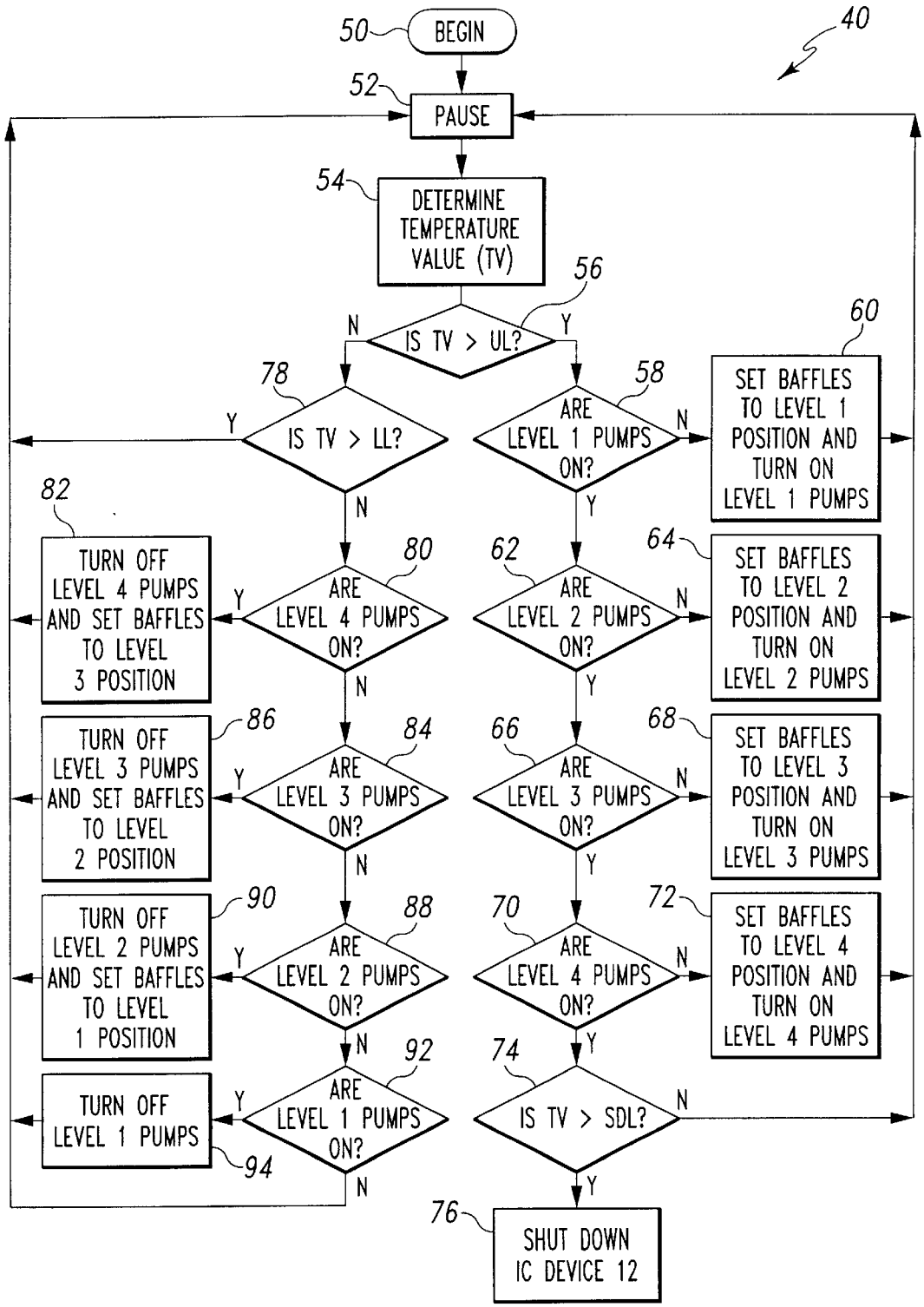
FIG. 5 is a flowchart setting forth a general routine which outlines the operation of the heat dissipating apparatus of FIG. 1.

FIG. 5 shows a flowchart which sets forth a general procedure or routine 40 for operation of the heat dissipating apparatus 10. A power-on control signal is generated by the integrated circuit device 12 to initiate a begin step 50. The begin step 50 starts an initialization process where a system check of the components of the heat dissipating apparatus 10 is performed. In particular, the apparatus 10 senses the functionality of the pumps 20, the baffles 22, and the sensors 24 to ensure their proper operation.

The routine 40 then advances to a pause step 52 where the apparatus 10 discontinues all temperature sensing activities for a given time period. The duration of the pause step 52 is preferably long enough such that any changes to the settings of the heat dissipating apparatus 10 (e.g. baffle location and pump operation state) by a prior iteration of the routine 40 will have a sufficient amount of time to affect the temperature of the integrated circuit device 12. It should be appreciated that the length of time of the pause step 52 may be increased or decreased based on user preference or system parameters. A pause step 52 consisting of a relatively short period of time will result in relatively more frequent sensing by the sensors 24 and updating of the settings of the heat dissipating apparatus 10 (e.g. baffle location and pump operation state), whereas a pause step 52 consisting of a relatively long period of time will result in relatively less frequent sensing by the sensors 24 and updating of such settings.

After the pause step 52 has elapsed, the routine 40 then proceeds to a temperature determination step 54. In the temperature determination step 54, the processor 26 receives temperature data from the sensors 24. In particular, each sensor 24 transmits temperature signals to the processor 26 which is indicative of temperature of a portion of the channel structure 16 proximate the respective sensor 24. The processor 26 determines a temperature value TV which may be an average temperature of all the temperature samples acquired by the temperature sensors 24.

The routine then proceeds to an upper limit comparing step 56 in which the temperature value TV is compared to a predetermined upper limit UL which is part of thermal tolerance data stored in the memory 28. The thermal tolerance data stored in the memory 28 represents operating limits for safe operation of the specific device which is being cooled (i.e. the integrated circuit device 12). If the processor 26 determines that the temperature value TV is above the predetermined upper limit UL, then the routine 40 proceeds to a pump query step 58.

In step 58, the processor 26 senses whether or not the level I pumps 20(1) are operating to advance fluid within the channels 18. If the processor 26 determines that the level I pumps 20(1) are not operating to advance fluid within the channels 18, then the routine 40 proceeds to step 60 where the processor 26 generates a control signal which cause (i) the baffles 22 to be set to their level I group position as shown in FIG. 6, and (ii) the level I pumps 20(1) to function to advance fluid within the channels 18, whereby fluid will be advanced in the recirculating path of movement shown in FIG. 6, and the routine 40 then returns to the pause step 52.

However, if in step 58, the processor 26 determines that the level I pumps 20(1) are operating to advance fluid within the channels 18, then the routine 40 proceeds to a pump query step 62. In step 62, the processor 26 senses whether or not the level II pumps 20(2) are operating to advance fluid within the channels 18. If the processor 26 determines that the level II pumps 20(2) are not operating to advance fluid within the channels 18, then the routine 40 proceeds to step 64 where the processor 26 generates a control signal which cause (i) the baffles 22 to be set to their level II group position as shown in FIG. 7, and (ii) the level II pumps 20(2) to function to advance fluid within the channels 18, whereby fluid will be advanced in the recirculating path of movement shown in FIG. 7, and the routine 40 then returns to the pause step 52.

If in step 62, the processor 26 determines that the level II pumps 20(2) are operating to advance fluid within the channels 18, then the routine 40 proceeds to a pump query step 66. In step 66, the processor 26 senses whether or not the level III pumps 20(3) are operating to advance fluid within the channels 18. If the processor 26 determines that the level III pumps 20(3) are not operating to advance fluid within the channels 18, then the routine 40 proceeds to step 68 where the processor 26 generates a control signal which cause (i) the baffles 22 to be set to their level III group position as shown in FIG. 8, and (ii) the level III pumps 20(3) to function to advance fluid within the channels 18, whereby fluid will be advanced in the recirculating path of movement shown in FIG. 8, and the routine 40 then returns to the pause step 52.

If in step 66, the processor 26 determines that the level III pumps 20(3) are operating to advance fluid within the channels 18, then the routine 40 proceeds to pump query step 70. In step 70, the processor 26 senses whether or not the level IV pumps 20(4) are operating to advance fluid within the channels 18. If the processor 26 determines that the level IV pumps 20(4) are not operating to advance fluid within the channels 18, then the routine 40 proceeds to step 72 where the processor 26 generates a control signal which cause (i) the baffles 22 to be set to their level IV group position as shown in FIG. 9, and (ii) the level IV pumps 20(4) to function to advance fluid within the channels 18, whereby fluid will be advanced in the recirculating path of movement shown in FIG. 9, and the routine 40 then returns to the pause step 52.

If in step 70, the processor 26 determines that the level IV pumps 20(4) are operating to advance fluid within the channels 18, then the routine 40 proceeds to a shut down limit comparing step 74. In step 74, the processor 26 compares the temperature value TV to a shut down temperature limit SDL which is part of the thermal tolerance data stored in the memory 28. The shut down temperature limit SDL stored in the memory 28 represents an absolute upper temperature limit over which the integrated circuit device 12 will not be allowed to operate. Thus, if the processor 26 determines that the temperature value TV is greater than the shut down temperature limit SDL, then the routine proceeds to a step 76 wherein the processor 26 generates a control signal which causes the integrated circuit to be shut down or otherwise inactivated. However, if the processor 26 determines that the temperature value TV is less than the shut down temperature limit SDL, then the routine 40 returns to the pause step 52.

Returning now to the upper limit comparing step 56, if the processor 26 determines that the temperature value TV is below a predetermined upper limit UL, then the routine 40 proceeds to a lower limit comparing step 78. In step 78, the temperature value TV is compared to a predetermined lower limit LL which is also part of the thermal tolerance data stored in the memory 28. If the processor 26 determines that the temperature value TV is above the predetermined lower limit LL, then the routine 40 returns to the pause step 52. Otherwise, if the processor 26 determines that the temperature value TV is below the predetermined lower limit LL, then the routine 40 advances to a pump query step 80.

In step 80, the processor 26 senses whether or not the level IV pumps 20(4) are operating to advance fluid within the channels 18. If the processor 26 determines that the level IV pumps 20(4) are operating to advance fluid within the channels 18, then the routine 40 proceeds to step 82 where the processor 26 generates a control signal which cause (i) the level IV pumps 20(4) to ceasing functioning so that they will not be operating to advance fluid within the channels 18, and (ii) the baffles 22 to be set to their level III group position as shown in FIG. 8, whereby fluid will be advanced in the recirculating path of movement shown in FIG. 8, and the routine 40 then returns to the pause step 52.

However, if in step 80, the processor 26 determines that the level IV pumps 20(4) are not operating to advance fluid within the channels 18, then the routine 40 proceeds to a pump query step 84. In step 84, the processor 26 senses whether or not the level III pumps 20(3) are operating to advance fluid within the channels 18. If the processor 26 determines that the level III pumps 20(3) are operating to advance fluid within the channels 18, then the routine 40 proceeds to step 86 where the processor 26 generates a control signal which cause (i) the level III pumps 20(3) to ceasing functioning so that they will not be operating to advance fluid within the channels 18, and (ii) the baffles 22 to be set to their level II group position as shown in FIG. 7, whereby fluid will be advanced in the recirculating path of movement shown in FIG. 7, and the routine 40 then returns to the pause step 52.

However, if in step 84, the processor 26 determines that the level III pumps 20(3) are not operating to advance fluid within the channels 18, then the routine 40 proceeds to a pump query step 88. In step 88, the processor 26 senses whether or not the level II pumps 20(2) are operating to advance fluid within the channels 18. If the processor 26 determines that the level II pumps 20(2) are operating to advance fluid within the channels 18, then the routine 40 proceeds to step 90 where the processor 26 generates a control signal which cause (i) the level II pumps 20(2) to ceasing functioning so that they will not be operating to advance fluid within the channels 18, and (ii) the baffles 22 to be set to their level I group position as shown in FIG. 6, whereby fluid will be advanced in the recirculating path of movement shown in FIG. 6, and the routine 40 then returns to the pause step 52.

However, if in step 88, the processor 26 determines that the level II pumps 20(2) are not operating to advance fluid within the channels 18, then the routine 40 proceeds to a pump query step 92. In step 92, the processor 26 senses whether or not the level I pumps 20(1) are operating to advance fluid within the channels 18. If the processor 26 determines that the level I pumps 20(1) are operating to advance fluid within the channels 18, then the routine 40 proceeds to step 94 where the processor 26 generates a control signal which cause (i) the level I pumps 20(1) to ceasing functioning so that they will not be operating to advance fluid within the channels 18, whereby no fluid will be advanced by any pumps 20 in the recirculating path of movement, and the routine 40 then returns to the pause step 52. Note that the group position of the baffles are not important at this time since no fluid is recirculating in the channels 18.

However, if in step 92, the processor 26 determines that the level I pumps 20(1) are not operating to advance fluid within the channels 18, then the routine 40 returns to the pause step 52.

While the invention has been illustrated and described in detail in the drawings and foregoing description, such illustration and description is to be considered as exemplary and not restrictive in character, it being understood that only preferred embodiments have been shown and described and that all changes and modifications that come within the spirit of the invention are desired to be protected.

While each of the baffles 22 are shown as being positionable in either one of two positions in the embodiment described herein and function to direct fluid flow in either a first direction or a second direction, it should be appreciated that other embodiments which incorporate the features of the present invention therein are contemplated. In particular, in one such contemplated alternative embodiment, each of the baffles 22 may be positionable at any one of more than two positions (e.g. three positions or four positions). For instance, if in such an alternative embodiment, each of the baffles 22 were positionable in any one of four positions, each of the baffles 22 may function to direct fluid flow in any one of a first direction, a second direction, a third direction, or a fourth direction.

There are a plurality of advantages of the present invention arising from the various features of the heat dissipating apparatus and method described herein. It will be noted that alternative embodiments of the heat dissipating apparatus and method of the present invention may not include all of the features described yet still benefit from at least some of the advantages of such features. Those of ordinary skill in the art may readily devise their own implementations of the heat dissipating apparatus and method that incorporate one or more of the features of the present invention and fall within the spirit and scope of the present invention ad defined by the appended claims.

What is claimed is:

1. An apparatus for dissipating heat generated by an electronic device, comprising:

a channel structure which is in thermal communication with an electronic device;

a temperature sensor positioned in thermal communication with said channel structure;

a circuit which generates a control signal if a temperature sensed by said temperature sensor is in a predetermined temperature range determined by thermal tolerance data for the electronic device;

a baffle positionable, in response to said control signal, at a first position and a second position, wherein (i) said baffle is positioned to direct fluid flow in a first flow path defined by said channel structure when said baffle is in said first position, and (ii) said baffle is positioned to direct fluid flow in a second flow path when said baffle is in said second position;

a first plurality of pumps configured to advance fluid through said first flow path; and a second plurality of pumps configured to advance fluid through said second flow path;

wherein said first plurality of pumps are also configured to advance fluid through said second flow path when said baffle is in said second position.

2. The apparatus of claim 1, wherein:

each of said first plurality of pumps is located within said first flow path defined by said channel structure, and each of said second plurality of pumps is located within said second flow path defined by said channel structure.

3. The apparatus of claim 2, wherein said channel structure includes an input port and an output port, further comprising:

an auxiliary heat dissipating element positioned in fluid communication with both said input port and said output port.

4. The apparatus of claim 3, further comprising:

a first external conduit for directing fluid exiting through said output port to said auxiliary heat dissipating element, and a second external conduit for directing fluid exiting said auxiliary heat dissipating element to said input port.

* * * * *